US012409984B2

(12) United States Patent
Hanlon

(10) Patent No.: US 12,409,984 B2
(45) Date of Patent: Sep. 9, 2025

(54) REVERSIBLE CAP FOR ADHESIVE CONTAINERS

(71) Applicant: WELD-ON ADHESIVES, INC., Compton, CA (US)

(72) Inventor: Aaron Hanlon, Gilbert, AZ (US)

(73) Assignee: WELD-ON ADHESIVES, INC., Compton, CA (US)

( * ) Notice: Subject to any disclaimer, the term of this patent is extended or adjusted under 35 U.S.C. 154(b) by 157 days.

(21) Appl. No.: 18/514,722

(22) Filed: Nov. 20, 2023

(65) Prior Publication Data

US 2025/0162767 A1 May 22, 2025

(51) Int. Cl.
*B65D 47/06* (2006.01)
*B65D 47/42* (2006.01)

(52) U.S. Cl.
CPC ..... *B65D 47/06* (2013.01); *B65D 47/42* (2013.01); *B65D 2251/09* (2013.01)

(58) Field of Classification Search
CPC ..... B65D 47/06; B65D 47/42; B65D 2251/09
See application file for complete search history.

(56) References Cited

U.S. PATENT DOCUMENTS 104,275 A * 6/1870 Corell ..... B65D 83/303 222/538
2,707,968 A * 5/1955 Efford ..... B65D 83/46 220/915
3,168,059 A * 2/1965 Germann ..... B65D 83/30 114/67 A
3,865,267 A * 2/1975 Morris ..... B65D 50/061 215/214
3,935,974 A * 2/1976 Weyn ..... B65D 83/30 222/182
4,036,385 A * 7/1977 Morris ..... B65D 50/046 215/221
4,226,339 A * 10/1980 Landsman ..... B65D 83/40 222/402.11
4,484,976 A 11/1984 Despins
5,044,803 A 9/1991 Kurosawa et al.
6,948,642 B2 9/2005 Awad
7,293,674 B2 11/2007 Abe et al.
8,905,264 B2 12/2014 White et al.
(Continued)

FOREIGN PATENT DOCUMENTS

BR 102018009895 A2 11/2019
CA 2825096 C 12/2019
(Continued)

*Primary Examiner* — Vishal Pancholi
(74) *Attorney, Agent, or Firm* — MYERS BIGEL, P.A.

(57) ABSTRACT

A reversible cap configured to be removably secured to a dispensing nozzle of a container containing a substance includes a body with a first end and an opposite second end. The first end and the second end of the cap body are each configured to be removably secured to the dispensing nozzle. At least one aperture is formed in a sidewall of the body and is in fluid communication with the second end. The first end, when secured to the dispensing nozzle, is configured to prevent the substance in the container from being dispensed through the dispensing nozzle. The second end, when secured to the dispensing nozzle, is configured to allow the substance to be dispensed through the dispensing nozzle and through the at least one aperture in the body.

26 Claims, 10 Drawing Sheets

(56) References Cited

U.S. PATENT DOCUMENTS

| | | | | |
|---|---|---|---|---|
| 9,038,866 | B2 | 5/2015 | Nelson et al. | |
| 9,333,527 | B2 | 5/2016 | Jurado Blazquez | |
| 9,364,849 | B2 | 6/2016 | Uehara | |
| 9,718,586 | B2 | 8/2017 | Yazdani | |
| 10,603,844 | B2 | 3/2020 | Khosravani et al. | |
| 11,472,608 | B2 * | 10/2022 | Shields | B65D 41/04 |
| 2018/0186519 | A1 * | 7/2018 | Chang | B65D 47/06 |
| 2022/0266290 | A1 | 8/2022 | Mcdonald | |

FOREIGN PATENT DOCUMENTS

| | | | |
|---|---|---|---|
| CN | 209156262 | U | 7/2019 |
| CN | 110976230 | A | 4/2020 |
| DE | 102010037504 | B3 | 12/2011 |
| DE | 202020002587 | U1 | 10/2020 |
| EP | 1500603 | B1 | 6/2011 |
| EP | 2361692 | B1 | 4/2014 |
| EP | 2586537 | B1 | 8/2015 |
| EP | 2702896 | B1 | 8/2018 |
| ES | 2553463 | T3 | 12/2015 |
| IN | 2014DN04200 | A | 2/2015 |
| JP | 5688640 | B2 | 2/2015 |
| MX | 337214 | B | 2/2016 |
| WO | 2014027762 | A1 | 2/2014 |
| WO | 2021000007 | A1 | 1/2021 |

* cited by examiner

REVERSIBLE CAP FOR ADHESIVE CONTAINERS

FIELD OF THE INVENTION

The present invention relates generally to containers and, more particularly, to caps for containers.

BACKGROUND OF THE INVENTION

Adhesive products (bonding agents) have been developed for joining thermoplastic, thermoset, and metallic pipe and fittings for a multitude of applications (both pressure and non-pressure). These bonding agents are typically applied to a pipe end and/or fitting socket with a brush prior to assembly.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

The present inventive concept is directed to a reversible cap for a container of adhesive used to join plastic pipes together. One end of the cap is a closed end and is threadingly secured to the container to prevent the adhesive from escaping from the container. When a user is ready to use the adhesive, the cap is unscrewed from the tube, flipped upside down, and threaded back onto the tube via an opposite end of the cap. The user then squeezes the tube and the adhesive flows through one or more apertures in the side of the cap. In some embodiments, the cap includes features that help spread the adhesive on a surface of a pipe or fitting. Once the user is done, they can throw the cap away if all the adhesive is used, or they can clean the cap and thread it back on the container using the closed end.

According to some embodiments of the present inventive concept, a cap configured to be removably secured to a dispensing nozzle of a tube containing a substance (e.g., an adhesive, etc.) includes a body with a first end and an opposite second end. The cap body can have various shapes and configurations. For example, in some embodiments, the cap body is cylindrical. The cap body may be formed from various polymeric materials, and may have a Shore-A hardness value of at least 85.

The first end and the second end of the cap body are each configured to be removably secured to the dispensing nozzle of the container. For example, in some embodiments, the dispensing nozzle is externally threaded, and the cap body first end and the cap body second end each include internal threads that are configured to engage the external threads of the dispensing nozzle. At least one aperture is formed in a sidewall of the body and is in fluid communication only with the second end. The first end is not in fluid communication with the at least one aperture and is a closed end. When secured to the dispensing nozzle, the first end is configured to prevent the substance in the tube from being dispensed through the dispensing nozzle. The second end, when secured to the dispensing nozzle, is configured to allow the substance to be dispensed through the dispensing nozzle and through the at least one aperture in the cap body.

In some embodiments, the cap body includes a member that serves as a piercer configured to pierce a seal of the dispensing nozzle when the body second end is removably secured to the dispensing nozzle.

In some embodiments, an exterior surface of the sidewall of the cap body includes features that are configured to facilitate application of the substance onto a surface (e.g., a surface of a pipe or fitting, etc.) when the substance is dispensed through the at least one aperture in the cap body. For example, in some embodiments, the features include a plurality of grooves and ridges. The plurality of grooves and ridges may be spaced apart along a longitudinal direction of the body. In other embodiments, the features include a plurality of spaced apart nubs extending outward from the exterior surface of the sidewall.

In some embodiments, the at least one aperture is a single, elongate aperture that extends along a longitudinal direction of the cap body. In some embodiments, an elongate recessed portion may be formed in an exterior surface of the sidewall adjacent to the elongate aperture. This recessed portion is configured to facilitate the distribution of a substance dispensed through the aperture, such as an adhesive, along the exterior surface of the cap body.

According to some embodiments of the present inventive concept, a container includes a deformable tube configured to contain a substance and a reversible cap configured to be removably secured to a dispensing nozzle of the tube. Compressive deformation of the tube causes forced egress of the substance therewithin through the open dispensing nozzle.

The cap includes a body having a first end and an opposite second end, wherein the first end and the second end are each configured to be removably secured to the dispensing nozzle. The cap body can have various shapes and configurations. For example, in some embodiments, the cap body is cylindrical. The cap body may be formed from various polymeric materials, and may have a Shore-A hardness value of at least 85.

At least one aperture is formed in a sidewall of the body and is in fluid communication with the second end. The first end is not in fluid communication with the at least one aperture and is a closed end. When secured to the dispensing nozzle of the tube, the first end is configured to prevent the substance in the tube from being dispensed through the dispensing nozzle. The second end, when secured to the dispensing nozzle of the tube, is configured to allow the substance to be dispensed through the dispensing nozzle and through the at least one aperture in the cap body.

In some embodiments, an exterior surface of the sidewall of the cap body includes features that are configured to facilitate application of the substance onto a surface (e.g., a surface of a pipe or fitting, etc.) when the substance is dispensed through the at least one aperture in the body. For example, in some embodiments, the features include a plurality of grooves and ridges. In other embodiments, the features include a plurality of nubs extending outward from the exterior surface of the sidewall.

In some embodiments, the at least one aperture is a single, elongate aperture that extends along a longitudinal direction of the cap body. In some embodiments, an elongate recessed portion may be formed in an exterior surface of the sidewall adjacent to the elongate aperture. This recessed portion is configured to facilitate the distribution of a substance dispensed through the aperture, such as an adhesive, along the exterior surface of the cap body.

It is noted that aspects of the present inventive concept described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present inventive concept are explained in detail below.

BRIEF DESCRIPTION OF THE DRAWINGS

The accompanying drawings, which form a part of the specification, illustrate various embodiments of the present inventive concept. The drawings and description together serve to fully explain embodiments of the present inventive concept.

DETAILED DESCRIPTION

Figure 1:
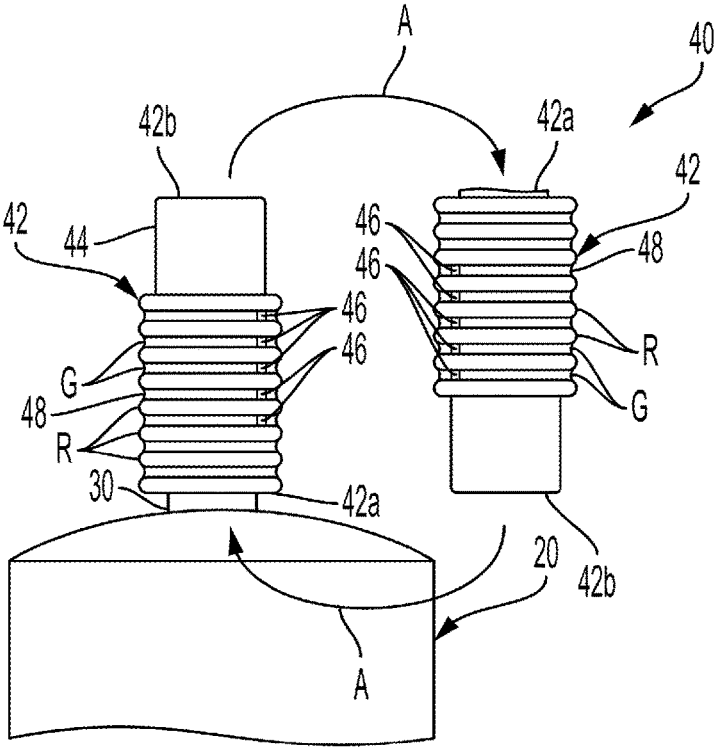
FIG. 1 illustrates a reversible cap for a container, according to some embodiments of the present inventive concept.

The present inventive concept will now be described more fully hereinafter with reference to the accompanying figures, in which embodiments of the inventive concept are shown. This inventive concept may, however, be embodied in many different forms and should not be construed as limited to the embodiments set forth herein. Like numbers refer to like elements throughout. In the figures, certain components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

When an element is referred to as being "connected", "coupled", "responsive", or variants thereof to another element, it can be directly connected, coupled, or responsive to the other element or intervening elements may be present. In contrast, when an element is referred to as being "directly connected", "directly coupled", "directly responsive", or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.," which derives from the Latin phrase "exempli gratia," may be used to introduce or specify a general example or examples of a previously mentioned item, and is not intended to be limiting of such item. The common abbreviation "i.e.," which derives from the Latin phrase "id est," may be used to specify a particular item from a more general recitation.

It will be understood that although the terms first, second, third, etc., may be used herein to describe various elements/operations, these elements/operations should not be limited by these terms. These terms are only used to distinguish one element/operation from another element/operation. Thus, a first element/operation in some embodiments could be termed a second element/operation in other embodiments without departing from the teachings of the present inventive concept. The same reference numerals or the same reference designators denote the same or similar elements throughout the specification.

The terms "about" and "approximately", as used herein with respect to a value or number, means that the value or number can vary by up to +/−twenty percent (20%).

Figure 2A:
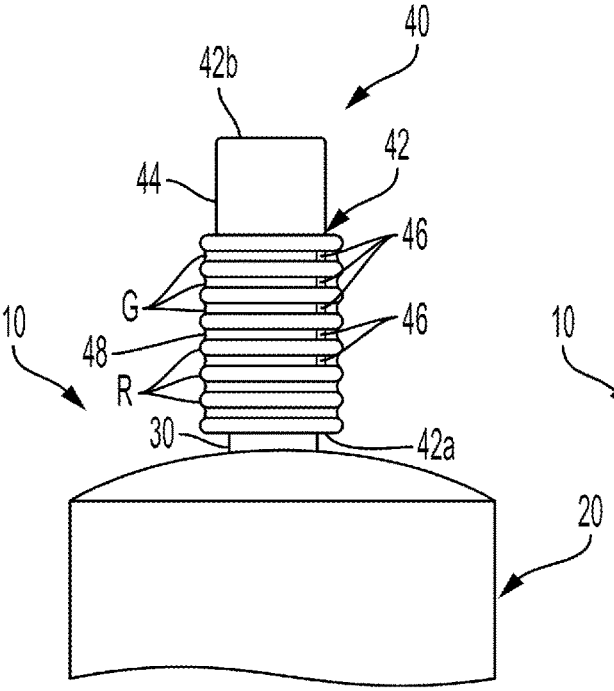
FIG. 2A illustrates the reversible cap of FIG. 1 secured to the dispensing nozzle of the container via the first end of the cap, and in which position a substance within the container is prevented from being dispensed through the dispensing nozzle.
Figure 2B:
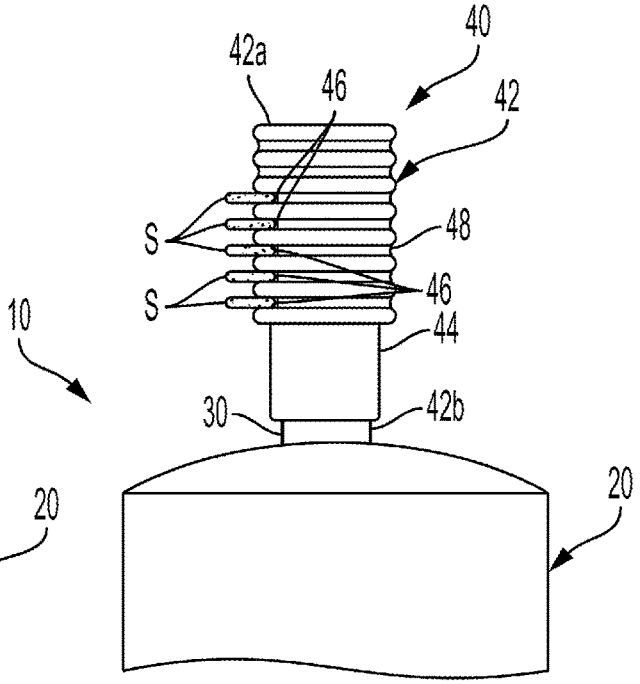
FIG. 2B illustrates the reversible cap of FIG. 1 secured to the dispensing nozzle of the container via the second end of the cap, and in which position the substance within the container is allowed to be dispensed through the dispensing nozzle and through at least one aperture in the cap.
Figure 3:
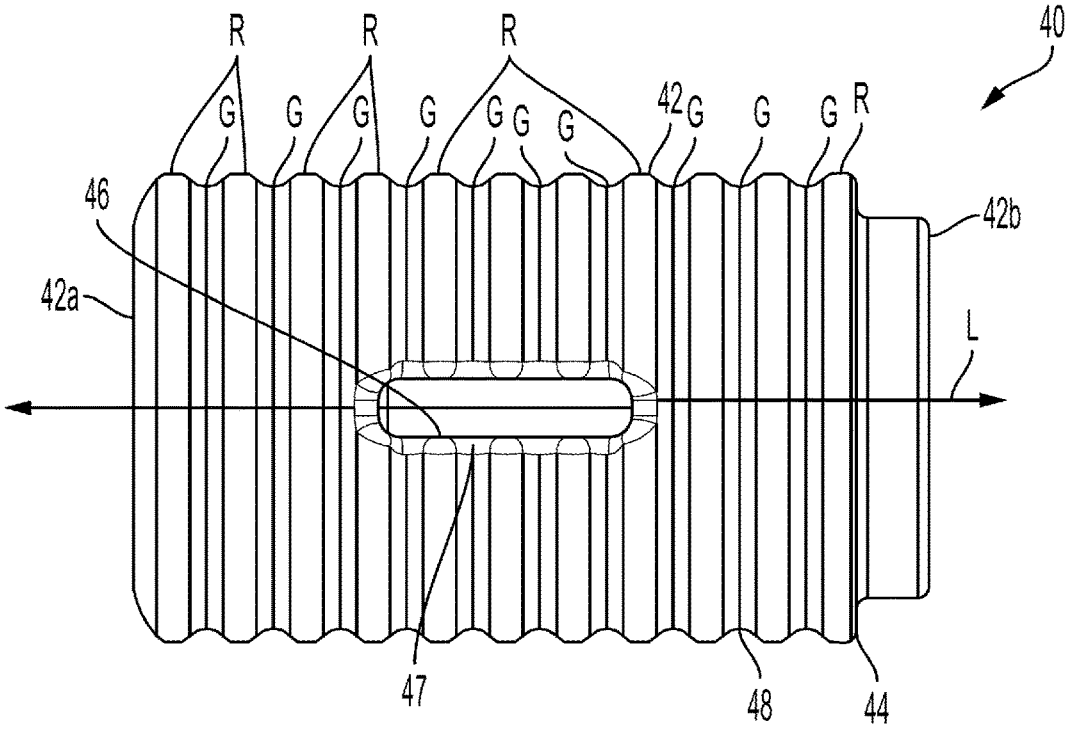
FIGS. 3-8 illustrate a reversible cap for a container according to other embodiments of the present inventive concept.
Figure 4:
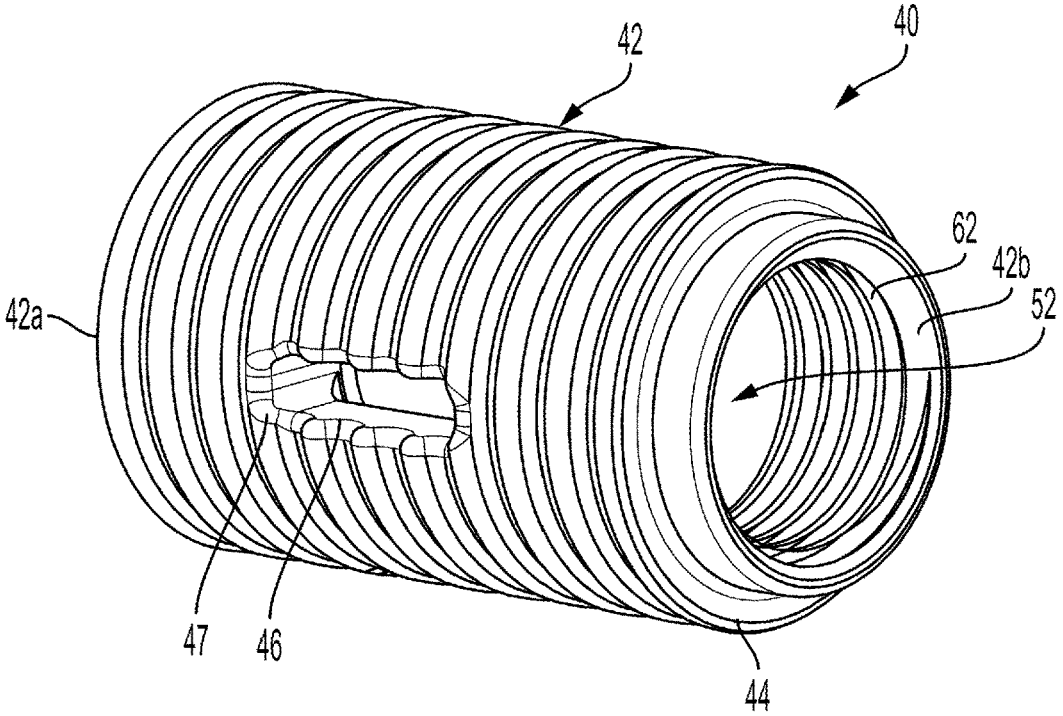
Figure 5:
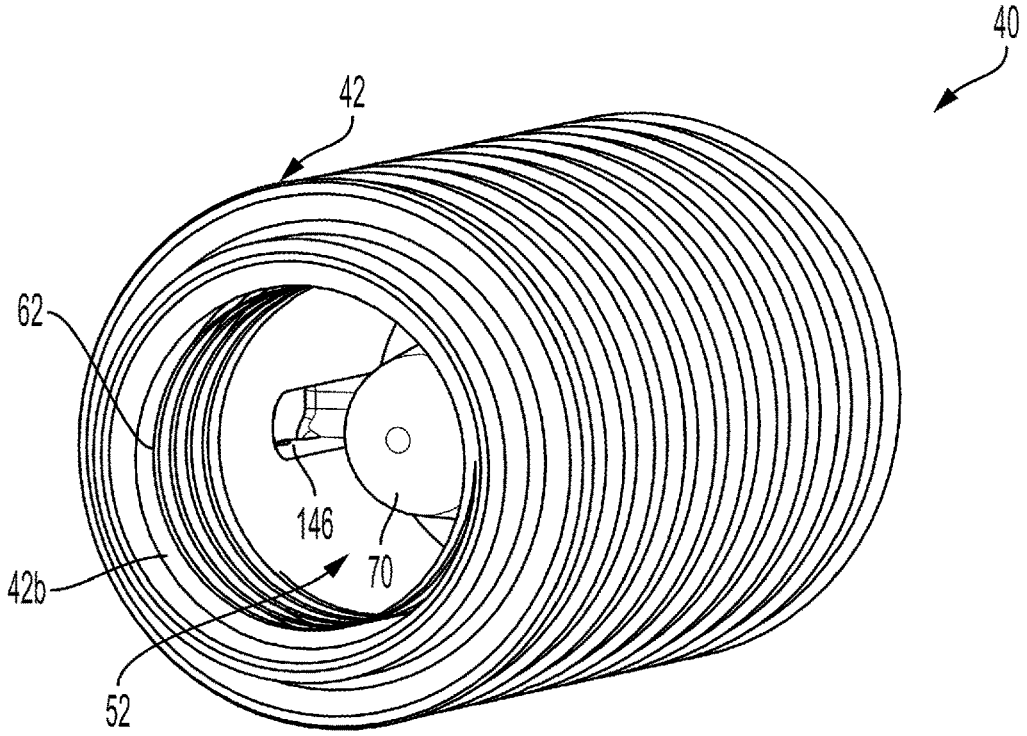
Figure 6:
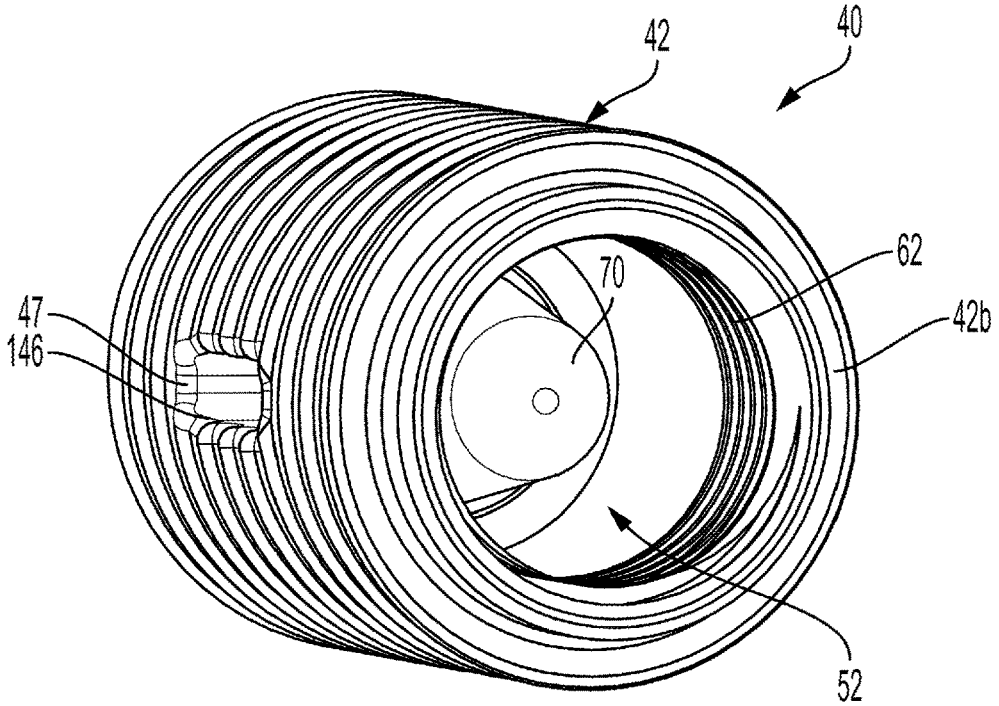
Figure 7:
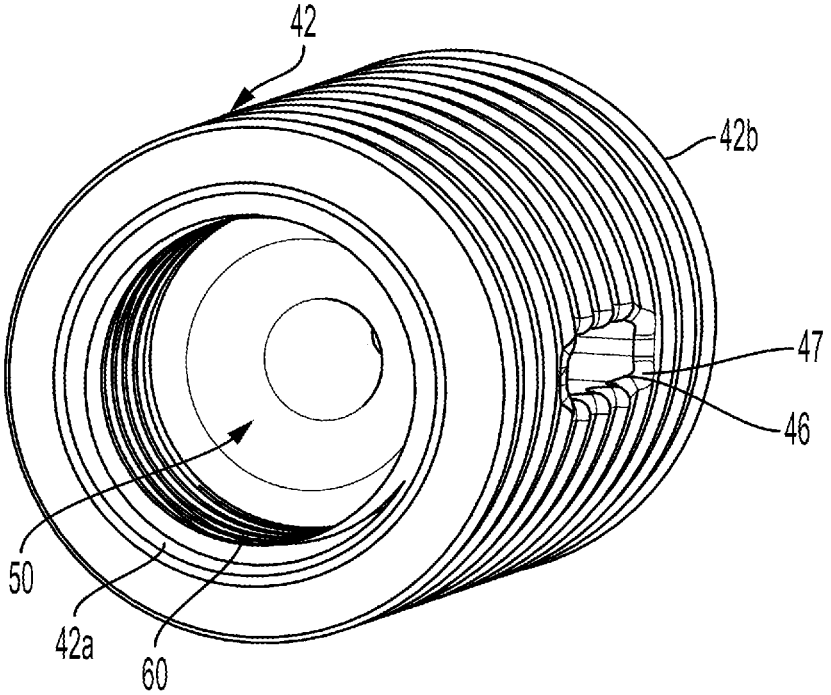
Figure 8:
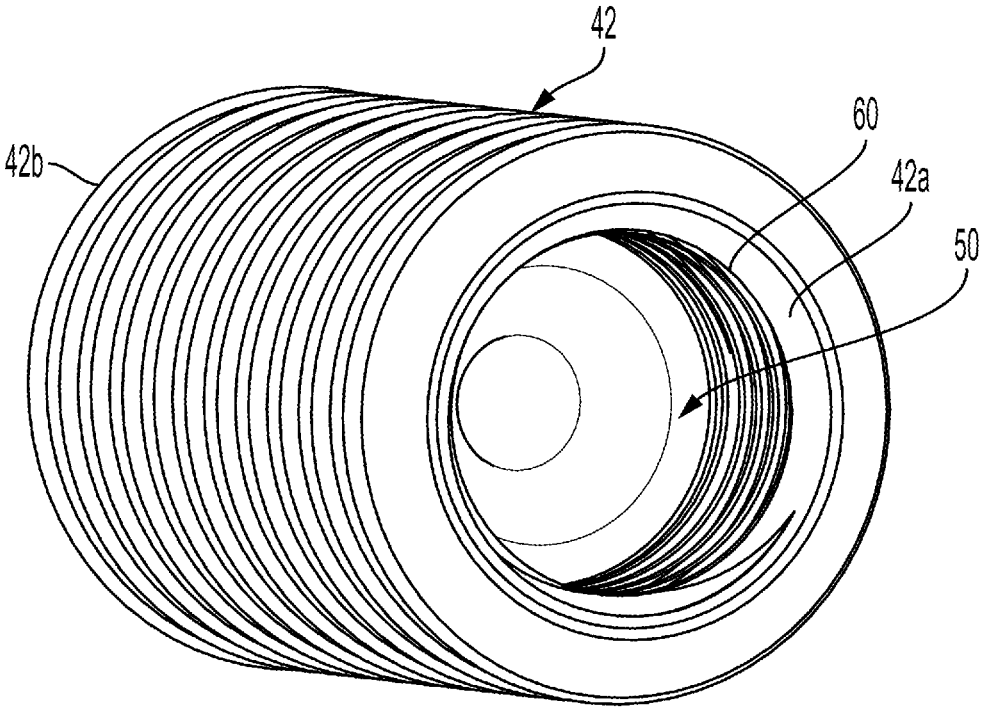

Referring initially to FIGS. 1 and 2A-2B, a container 10 for a substance, such as adhesive used to join plastic pipes together, is illustrated. In the illustrated embodiment, the container includes a deformable tube 20 that contains the substance, and a reversible cap 40 that is removably secured to a dispensing nozzle 30 of the tube 20. With the cap 40 removed from the dispensing nozzle 30, compressive deformation of the tube 20, for example via a user's hand, etc., causes forced egress of the substance from the tube 20 and through the open dispensing nozzle 30.

The reversible cap 40 includes a body 42 having a first end 42*a* and an opposite second end 42*b*. The first end and the second end are each configured to be removably secured to the dispensing nozzle 30. The dispensing nozzle 30 contains external threads, and both the first end 42*a* and second end 42*b* of the cap body 42 have internal threads that are configured to engage the external threads of the dispensing nozzle 30. As such, the cap 40 is reversible in that the first end 42*a* of the cap body 42 and the second end 42*b* of the cap body 42 can be removably secured to the dispensing nozzle 30.

The cap body 42 can have various shapes and configurations. For example, in the illustrated embodiment, the cap body 42 has a cylindrical configuration. However, in other embodiments, the cap body 42 may have an oval configuration or a polygonal configuration, such as a square shape, a rectangular shape, a hexagonal shape, etc. Embodiments of the present inventive concept are not limited to the cap body 42 having a specific shape, however. The cap body 42 may be formed from various polymeric materials, such as silicone and polypropylene. However, other polymeric materials may be utilized, also. In some embodiments, the polymeric material of the cap body 42 has a Shore-A hardness value of at least 85.

A sidewall 44 of the cap body 42 includes at least one aperture 46 formed therethrough. The at least one aperture 46 is in fluid communication with the second end 42 of the cap body 42. In the illustrated embodiment of FIGS. 1 and 2A-2B, the at least one aperture 46 is a plurality of spaced apart apertures 46. In the embodiments of FIGS. 3-18, described below, the at least one aperture is a single, elongated aperture 46.

The first end 42*a* of the cap body 42 is a "closed end" because the at least one aperture 46 is not in fluid communication with the first end 42*a*. As such, the first end 42*a*, when secured to the dispensing nozzle 30, is configured to prevent the substance in the tube 20 from being dispensed through the dispensing nozzle 30. Typically, the tube 20 may be shipped and stored with the first end 42*a* of the cap body 42 secured thereto. However, the second end 42*b*, when secured to the dispensing nozzle, is configured to allow the substance S to be dispensed through the dispensing nozzle 30 and through the at least one aperture 46 in the sidewall 44 of the cap body 42.

The operation of the reversible cap 40 is illustrated in FIGS. 1 and 2A-2B. In FIG. 1, the first end 42*a* of the cap body 42 is secured to the dispensing nozzle 30, for example, for shipping and storage of the tube. The arrows A in FIG. 1 represent the reversibility of the cap (i.e., the cap 40 can be flipped upside down so that the second end 42*b* can be secured to the dispensing nozzle 30.) FIG. 2A illustrates the cap 40 secured to the dispensing nozzle 30 of the tube 20 via the first end 42*a* of the cap body 42, as in FIG. 1. FIG. 2B illustrates the cap 40 reversed and secured to the dispensing nozzle 30 of the tube 20 via the second end 42*b* of the cap body 42. Compressive deformation of the tube 20 in FIG. 2B causes the substance S in the tube 20 to flow through the dispensing nozzle 30, into the second end 42*b* of the cap body 42, and out through the apertures 46 formed in the sidewall 44 of the cap body 42. The cap 40 can then be used as an applicator to apply the substance S to a surface of another object, e.g., a pipe or fitting, etc.

In the illustrated embodiment of FIGS. 1 and 2A-2B, the exterior surface 48 of the sidewall 44 of the cap body 42 includes features that are configured to facilitate application of the substance S onto a surface when the substance S is dispensed through the at least one aperture 46 in the cap body 42. These features in the embodiment illustrated in FIGS. 1 and 2A-2B are a plurality of grooves G and ridges R. These grooves and ridges G, R facilitate the even application of the substance S onto a surface of an object as the substance S is dispensed from the tube 20. In other embodiments, as illustrated in FIGS. 10-17, the features include a plurality of nubs N extending outward from the exterior surface 48 of the sidewall 44 of the cap body 42.

Thus, embodiments of the present inventive concept provide a reversible cap 40 that is configured to prevent a substance, such as an adhesive, within a tube 20 from being dispensed when the first end 42*a* of the cap 40 is secured to the tube 20. When a user is ready to dispense the substance S from the tube 20, the cap 40 is unscrewed from the tube 20, flipped upside down, and the second end 42*b* is threaded onto the tube 20. The user then squeezes the tube 20 and the substance S flows through the one or more apertures 46 in the sidewall 44 of the cap 40. The cap 40 further operates as an applicator with features configured to help evenly apply the substance S to a surface of another object.

Referring now to FIGS. 3-8, a reversible cap 40 for a container, according to other embodiments of the present inventive concept, is illustrated. The illustrated cap 40 is similar to the cap 40 of FIGS. 1 and 2A-2B and includes a body 42 having a first end 42*a* and an opposite second end 42*b*. The first end 42*a* and the second end 42*b* are each configured to be removably secured to the dispensing nozzle of a container. Both the first end 42*a* and second end 42*b* of the cap body 42 have internal threads 60, 62 that are configured to engage the external threads of the dispensing nozzle of the container, such as the tube 20 illustrated in FIGS. 9A-9B.

A sidewall 44 of the cap body 42 includes a single aperture 46 formed therethrough that is in fluid communication with the second end 42*b* of the cap body 42. The illustrated aperture 46 has an elongated configuration that extends along a longitudinal direction L of the cap body 42. However, the aperture 46 may have various shapes and configurations. The illustrated aperture 46 has a length that is approximately one third of the length of the cap body 43. However, the aperture 46 may have other lengths, including a length that is greater than one third of the length of the cap body 43, and a length that is less than one third of the length of the cap body 43. Moreover, the aperture 46 may be oriented transverse to the longitudinal direction L of the cap body 42, in other embodiments.

The illustrated aperture 46 is located in a central portion of the sidewall 44. However, in other embodiments, the aperture 46 may be located closer to one of the ends 42*a*, 42*b* of the cap body 42.

The illustrated aperture 46 has an angled or tapered peripheral edge 47, as illustrated. The angled/tapered configuration of the peripheral edge helps direct the flow of a substance, such an adhesive, that is being dispensed through the aperture 46 onto the exterior surface 48 of the sidewall 44 of the cap body 42.

The first end 42*a* of the cap body 42 defines a closed internal chamber 50 (FIGS. 7-8) that is not in fluid communication with the aperture 46. As such, the first end 42*a*, when secured to a dispensing nozzle of a container, is configured to prevent a substance in the container from being dispensed through the dispensing nozzle. The first end 42*a* includes internal threads 60 that are configured to engage external threads on the dispensing nozzle of the container.

The second end 42*b* of the cap body 42 defines an internal chamber 52 that is in fluid communication with the aperture 46. As such, the second end 42*b*, when secured to the dispensing nozzle of the container, is configured to allow the substance in the container to be dispensed through the dispensing nozzle, into the internal chamber 52, and out through the aperture 46 in the sidewall 44 of the cap body 42. The second end 42*b* includes internal threads 62 that are configured to engage external threads on the dispensing nozzle.

The exterior surface 48 of the sidewall 44 of the cap body 42 includes grooves G and ridges R to facilitate the application of a substance, such as an adhesive material, onto a surface of an object as the substance is dispensed from the container to which the cap 140 is attached.

Figure 9A:
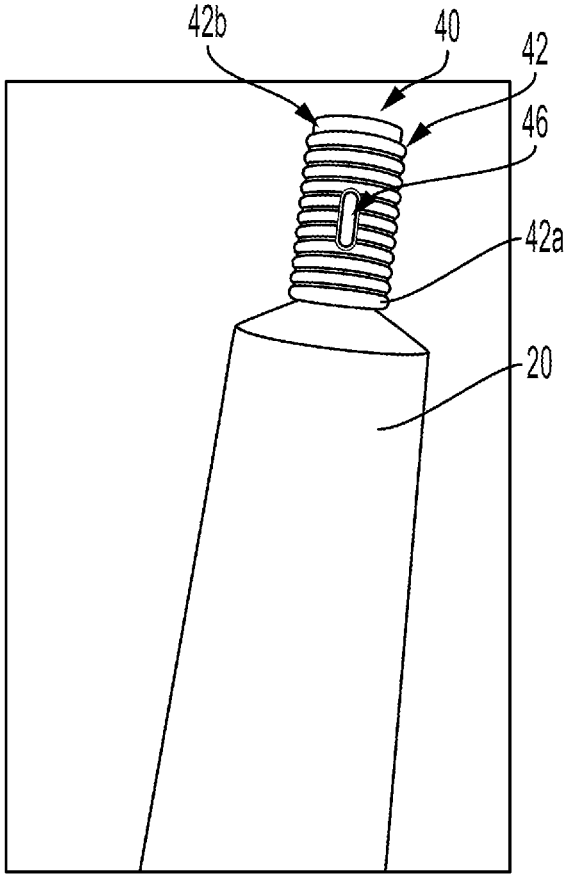
FIG. 9A illustrates the reversible cap of FIGS. 3-8 secured to the dispensing nozzle of a container via the first end of the cap, and in which position a substance within the container is prevented from being dispensed through the dispensing nozzle.
Figure 9B:
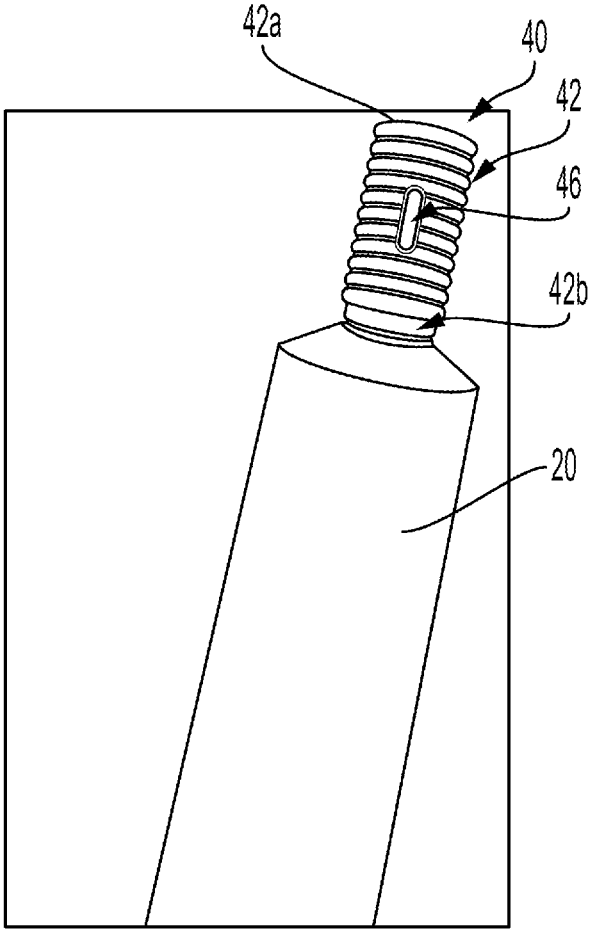
FIG. 9B illustrates the reversible cap of FIGS. 3-8 secured to the dispensing nozzle of the container via the second end of the cap, and in which position the substance within the container is allowed to be dispensed through the dispensing nozzle and through the aperture in the sidewall of the cap.
Figure 10:
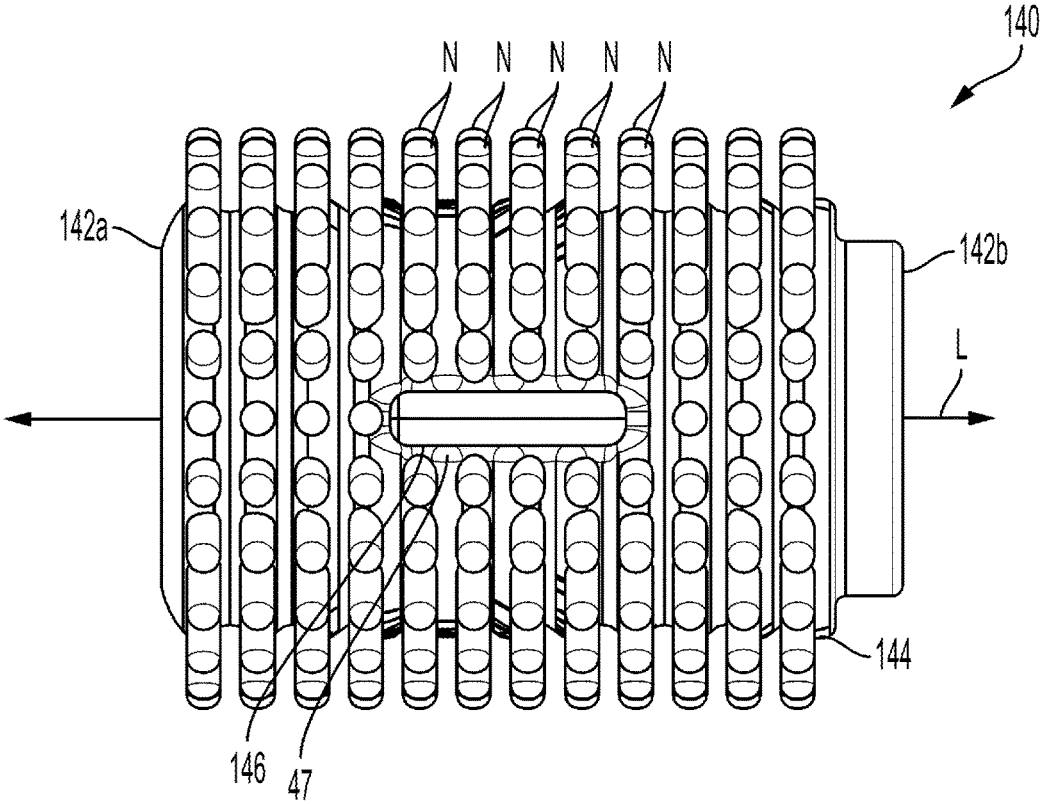
FIGS. 10-15 illustrate a reversible cap for a container according to other embodiments of the present inventive concept.
Figure 11:
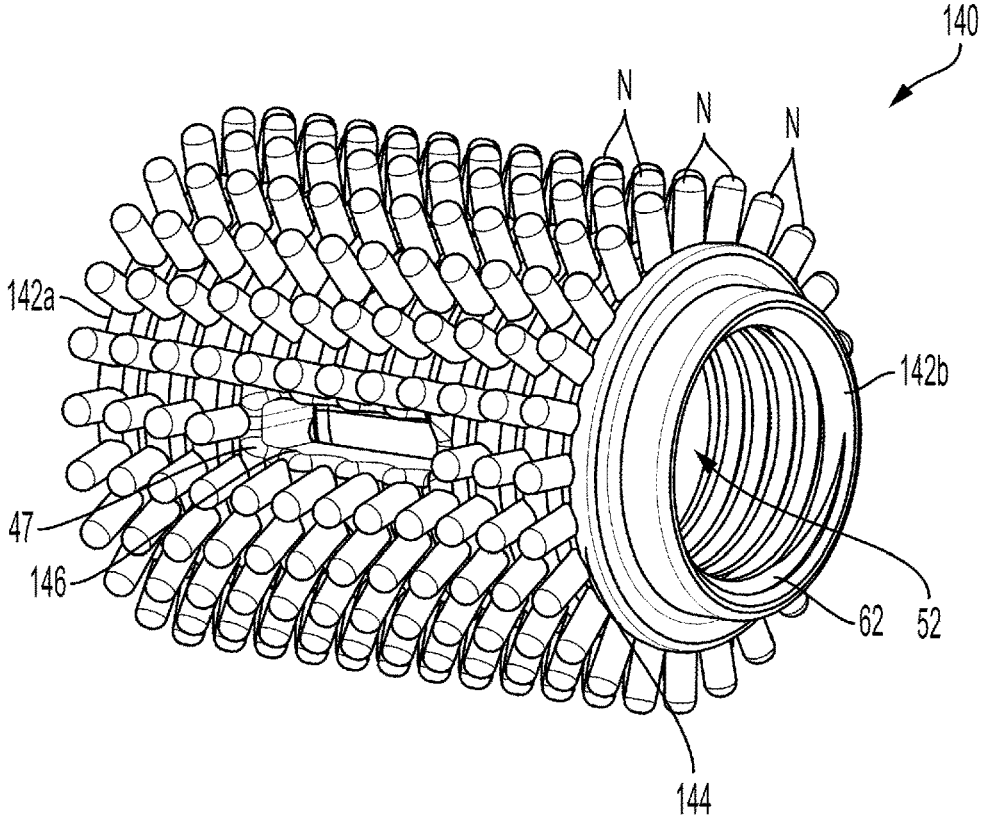
Figure 12:
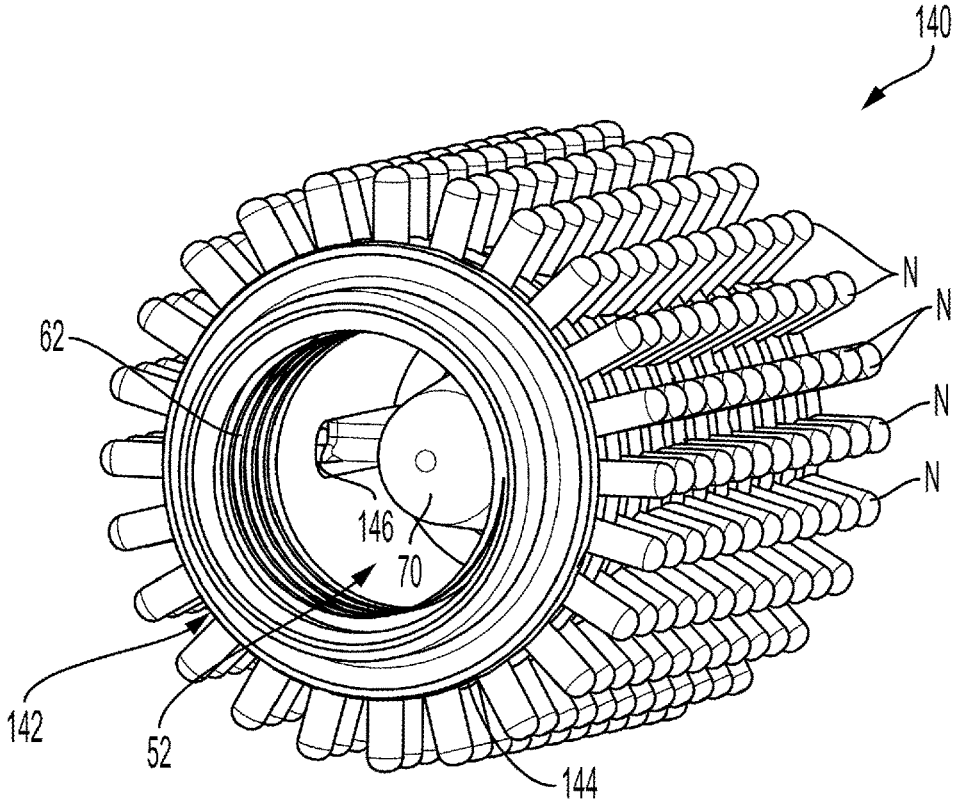
Figure 13:
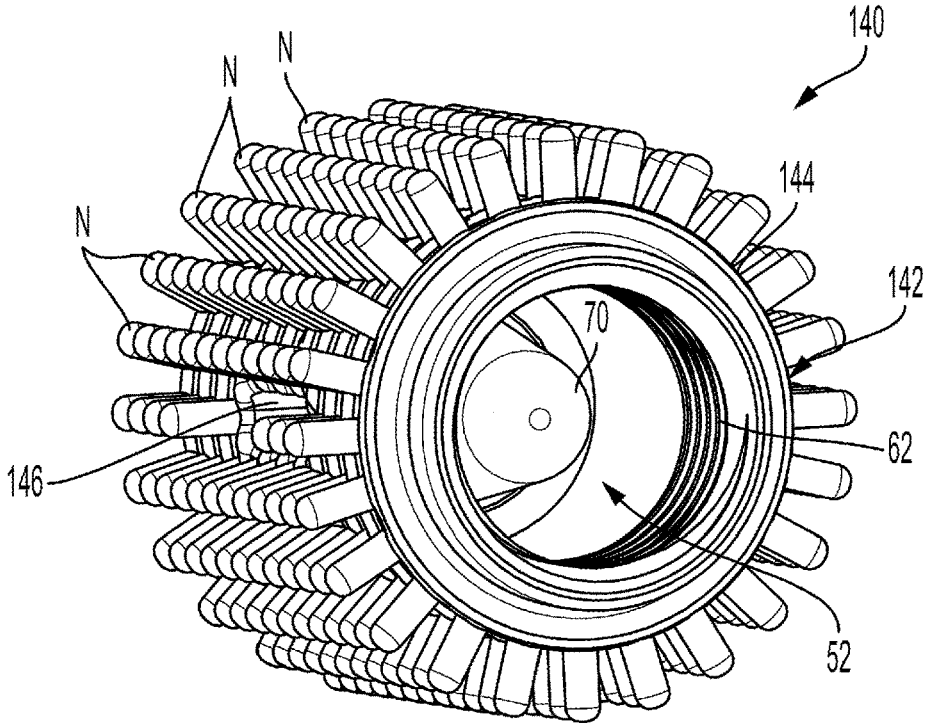
Figure 14:
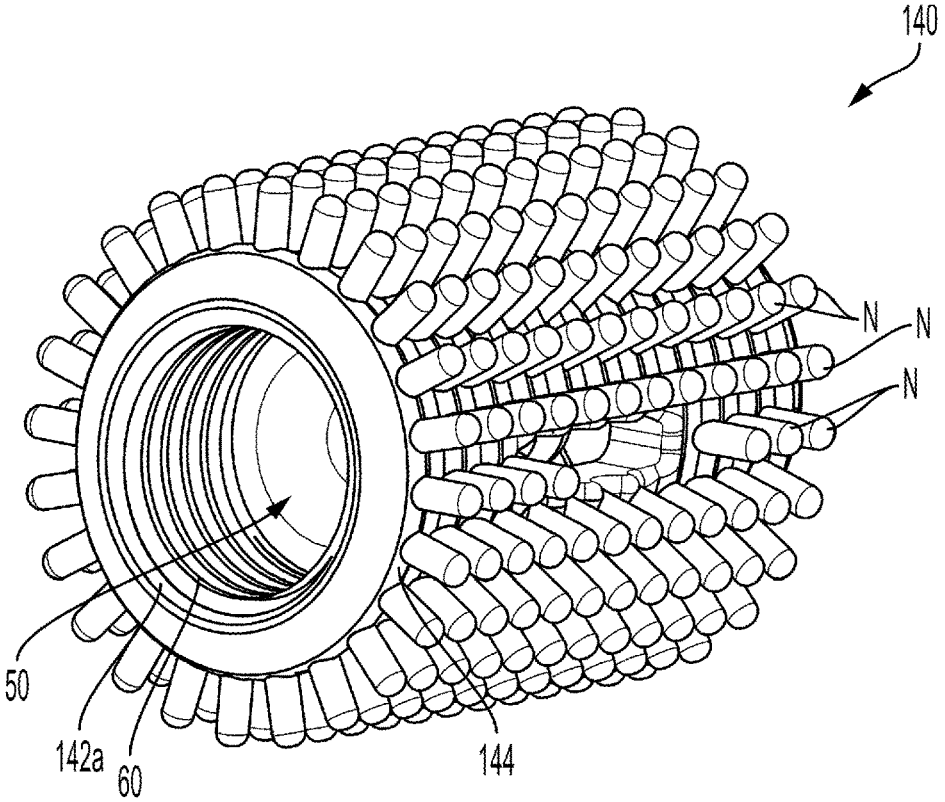
Figure 15:
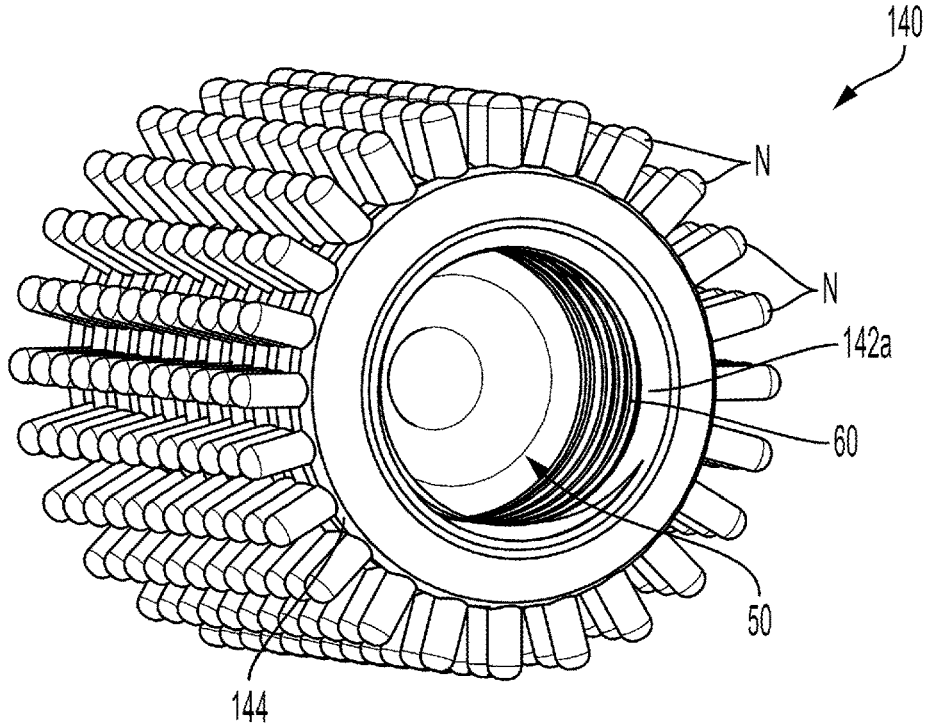

FIG. 9A illustrates the cap 40 of FIGS. 3-8 secured to the dispensing nozzle of a tube 20 via the first end 42*a* of the cap 40, and in which position a substance within the tube 20 is prevented from being dispensed through the dispensing nozzle of the tube 20. FIG. 9B illustrates the cap 40 of FIGS. 3-8 secured to the dispensing nozzle of the tube 20 via the second end 42*b* of the cap 40, and in which position the substance within the tube 20 is allowed to be dispensed through the dispensing nozzle of the tube 20 and out through the aperture 46 in the cap.

In some embodiments, the send end 42*b* of the cap body 42 includes a member 70 that is configured to pierce a seal of the dispensing nozzle of a container when the cap body second end 42*b* is removably secured to the dispensing nozzle.

Referring now to FIGS. 10-15, a reversible cap 140 for a container of a substance, such as an adhesive, according to other embodiments of the present inventive concept, is illustrated. The illustrated cap 140 is similar to the cap 40 of FIGS. 1 and 2A-2B and includes a body 142 having a first end 142*a* and an opposite second end 142*b*. The first end 142*a* and the second end 142*b* are each configured to be removably secured to the dispensing nozzle of a container. Both the first end 142*a* and second end 142*b* of the cap body 142 have internal threads 60, 62 that are configured to engage the external threads of the dispensing nozzle of the container.

A sidewall 144 of the cap body 142 includes a single aperture 146 formed therethrough that is in fluid communication with the second end 142*b* of the cap body 142. The illustrated aperture 146 has an elongated configuration that extends along a longitudinal direction L of the body 142. However, the aperture 146 may have various shapes and configurations, and may be oriented transverse to the longitudinal direction L of the cap body 142 in other embodiments.

The first end 142*a* of the cap body 142 defines a closed internal chamber 50 (FIGS. 14-15) that is not in fluid communication with the aperture 146. As such, the first end 142*a*, when secured to a dispensing nozzle of a container, is configured to prevent the substance in the container from being dispensed through the dispensing nozzle. The first end 142*a* includes internal threads 60 that are configured to engage external threads on the dispensing nozzle of a container.

The second end 142*b* of the cap body 142 defines an internal chamber 52 that is in fluid communication with the aperture 146. As such, the second end 142*b*, when secured to a dispensing nozzle of a container, is configured to allow the substance in the container to be dispensed through the dispensing nozzle, into the internal chamber 52, and out through the aperture 146 in the sidewall 144 of the cap body 142. The second end 142*b* includes internal threads 62 that are configured to engage external threads on the dispensing nozzle of a container.

The exterior surface 148 of the sidewall 144 of the cap body 142 includes a plurality of nubs N extending outward therefrom that are configured to facilitate the application of a substance, such as an adhesive material, onto a surface of an object as the substance is dispensed from a container to which the cap 140 is attached. The nubs N extend radially outward from the exterior surface 148 and are positioned circumferentially around the cap body 142, as illustrated. In the illustrated embodiment, substantially the entire exterior surface 148 of the cap body 142 has nubs extending outwardly therefrom. However, in other embodiments, only a portion of the exterior surface 148, may have nubs N extending outwardly therefrom.

Figure 16:
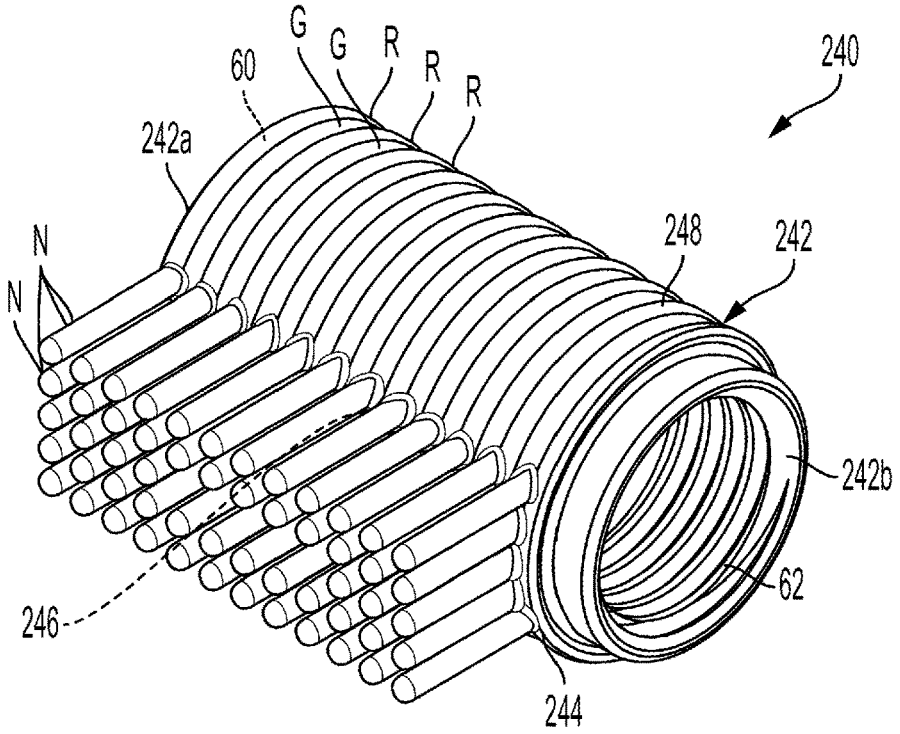
FIG. 16 illustrates a reversible cap for a container according to other embodiments of the present inventive concept.
Figure 17:
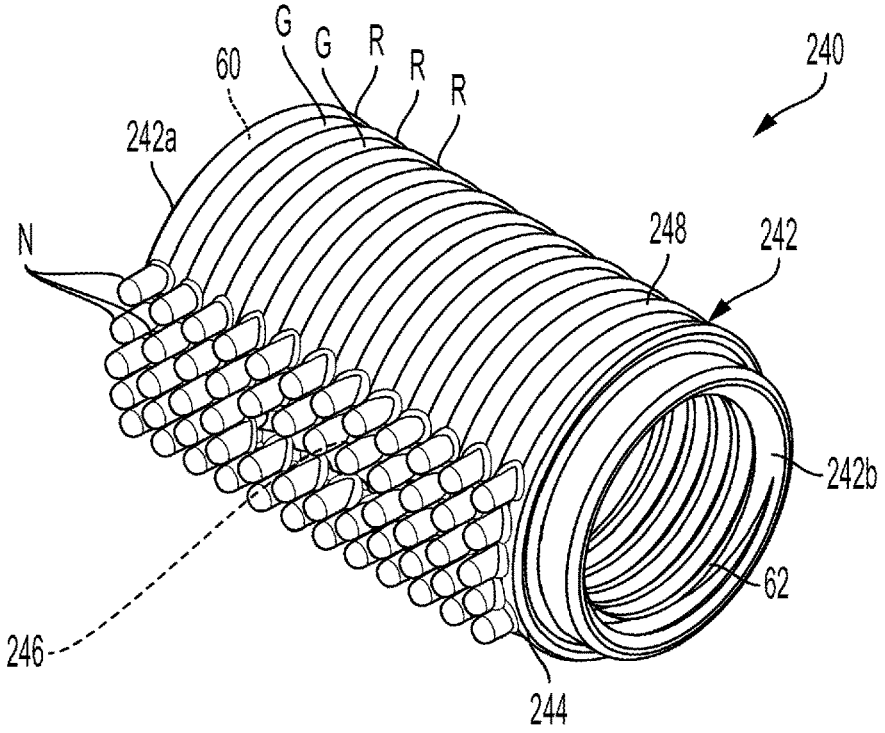
FIG. 17 illustrates a reversible cap for a container according to other embodiments of the present inventive concept.

Referring to FIGS. 16 and 17, a reversible cap 240 according to other embodiments of the present inventive concept is illustrated. The illustrated cap 240 is similar to the cap 40 of FIGS. 3-8 and includes a body 242 having a first end 142*a* and an opposite second end 242*b*. The first end 242*a* and the second end 242*b* have internal threads 60, 62 that are configured to engage an externally threaded dispensing nozzle of a container. A sidewall 244 of the cap body 242 includes a single aperture 246 formed therethrough that is in fluid communication with the second end 242*b* of the cap body 142. Nubs N extend outwardly from a portion of the exterior surface 248 immediately adjacent to the aperture 246. The remaining portion of the exterior surface 248 includes grooves G and ridges R. The nubs N in the embodiment of FIG. 16 are longer than the nubs N in the embodiment of FIG. 17.

Figure 18:
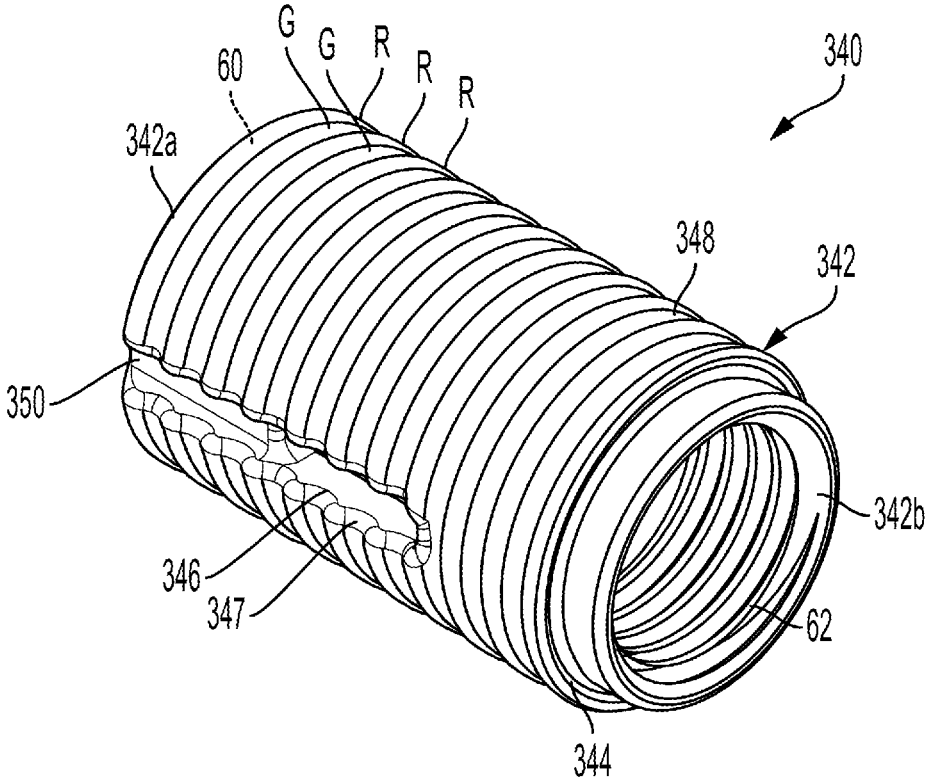
FIG. 18 illustrates a reversible cap for a container according to other embodiments of the present inventive concept.

Referring to FIG. 18, a reversible cap 340 according to other embodiments of the present inventive concept is illustrated. The illustrated cap 340 is similar to the cap 40 of FIGS. 3-8 and includes a body 342 having a first end 342*a* and an opposite second end 342*b*. The first end 342*a* and the second end 342*b* have internal threads 60, 62 that are configured to engage an externally threaded dispensing nozzle of a container. A sidewall 344 of the cap body 342 includes a single aperture 346 formed therethrough that is in fluid communication with the second end 342*b* of the cap body 342. The exterior surface 348 includes grooves G and ridges R.

An elongate, recessed portion 350 is formed in the exterior surface 348 of the sidewall adjacent to the elongate aperture 346, as illustrated. The recessed portion 350 facilitates the spreading of a substance, such as an adhesive, being dispensed through the aperture 346 along the exterior surface 348 of the cap body 342. This helps facilitate the application of the substance to a surface of another object, such as a pipe. Embodiments of the present inventive concept are not limited to the illustrated configuration of the recessed portion 350. The recessed portion 350 may have various shapes and configurations. In addition, another recessed portion may be formed in the exterior surface 348 of the sidewall adjacent the opposite end of the illustrated aperture 346.

Although a tube 20 is illustrated in FIGS. 1, 2A-2B and 9A-9B as a container for a substance, it is to be understood that the reversible cap 40, 140, 240, 340, according to embodiments of the present inventive concept, can be utilized with various other types of containers. Embodiments of the present inventive concept are not limited to the use of the reversible cap 40, 140, 240, 340 only with tubes.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A cap configured to be removably secured to an externally threaded dispensing nozzle of a container, the cap comprising:

a body having a first end and an opposite second end, wherein the first end and the second end are each configured to be removably secured to the dispensing nozzle, wherein the body first end and the body second end each comprise internal threads configured to engage the externally threaded dispensing nozzle; and at least one aperture in a sidewall of the body that is in fluid communication with the second end, wherein the first end, when secured to the dispensing nozzle, is configured to prevent a substance in the container from being dispensed through the dispensing nozzle, and wherein the second end, when secured to the dispensing nozzle, is configured to allow the substance to be dispensed through the dispensing nozzle and through the at least one aperture in the body.

2. The cap of claim 1, wherein the body comprises a piercer that is configured to pierce a seal of the dispensing nozzle when the body second end is removably secured to the dispensing nozzle.

3. The cap of claim 1, wherein an exterior surface of the sidewall comprises a plurality of grooves and ridges that are configured to facilitate application of the substance onto a surface when the substance is dispensed through the at least one aperture in the body.

4. The cap of claim 3, wherein the plurality of grooves and ridges are spaced apart along a longitudinal direction of the body.

5. The cap of claim 1, wherein at least a portion of an exterior surface of the sidewall comprises a plurality of nubs extending outward therefrom that are configured to facilitate application of the substance onto a surface when the substance is dispensed through the at least one aperture in the body.

6. The cap of claim 1, wherein the at least one aperture comprises a single, elongate aperture that extends along a longitudinal direction of the body.

7. The cap of claim 6, further comprising an elongate recessed portion formed in an exterior surface of the sidewall adjacent to the elongate aperture.

8. The cap of claim 1, wherein the body is cylindrical.

9. The cap of claim 1, wherein the body comprises a polymeric material having a Shore-A hardness value of at least 85.

10. A cap configured to be removably secured to a dispensing nozzle of a container, the cap comprising:

a body having an internally threaded first end and an opposite internally threaded second end, wherein the first end and the second end are each configured to engage external threads on the dispensing nozzle; and at least one aperture in a sidewall of the body that is in fluid communication with the second end, wherein the first end, when secured to the dispensing nozzle, is configured to prevent a substance in the container from being dispensed through the dispensing nozzle, wherein the second end, when secured to the dispensing nozzle, is configured to allow the substance to be dispensed through the dispensing nozzle and through the at least one aperture in the body, and wherein at least a portion of an exterior surface of the sidewall comprises features that are configured to facilitate application of the substance onto a surface when the substance is dispensed through the at least one aperture in the body.

11. The cap of claim 10, wherein the features comprise a plurality of grooves and ridges.

12. The cap of claim 11, wherein the plurality of grooves and ridges are spaced apart along a longitudinal direction of the body.

13. The cap of claim 10, wherein the features comprise a plurality of nubs extending outward from the exterior surface of the sidewall.

14. The cap of claim 10, wherein the at least one aperture comprises a single, elongate aperture that extends along a longitudinal direction of the body.

15. The cap of claim 14, further comprising an elongate recessed portion formed in an exterior surface of the sidewall adjacent to the elongate aperture.

16. A container, comprising:

a deformable tube configured to contain a substance, the tube comprising a dispensing nozzle, and wherein compressive deformation of the tube causes forced egress of the substance therewithin through the dispensing nozzle; and a cap, comprising:

a body having a first end and an opposite second end, wherein the first end and the second end are each configured to be removably secured to the dispensing nozzle; and at least one aperture in a sidewall of the body that is in fluid communication with the second end, wherein the first end, when secured to the dispensing nozzle, is configured to prevent the substance in the tube from being dispensed through the dispensing nozzle, and wherein the second end, when secured to the dispensing nozzle, is configured to allow the substance to be dispensed through the dispensing nozzle and out through the at least one aperture in the body.

17. The container of claim 16, wherein at least a portion of an exterior surface of the sidewall comprises features that are configured to facilitate application of the substance onto a surface when the substance is dispensed through the at least one aperture in the body.

18. The container of claim 17, wherein the features comprise a plurality of grooves and ridges.

19. The container of claim 18, wherein the plurality of grooves and ridges are spaced apart along a longitudinal direction of the body.

20. The container of claim 17, wherein the features comprise a plurality of nubs extending outward from the exterior surface of the sidewall.

21. The container of claim 16, wherein the at least one aperture comprises a single, elongate aperture that extends along a longitudinal direction of the body.

22. The container of claim 16, wherein the body of the cap is cylindrical.

23. The container of claim 16, wherein the body of the cap comprises a polymeric material having a Shore-A hardness value of at least 85.

24. A cap configured to be removably secured to a dispensing nozzle of a container, the cap comprising:

a body having a first end and an opposite second end, wherein the first end and the second end are each configured to be removably secured to the dispensing nozzle; and at least one aperture in a sidewall of the body that is in fluid communication with the second end, wherein the first end, when secured to the dispensing nozzle, is configured to prevent a substance in the container from being dispensed through the dispensing nozzle, wherein the second end, when secured to the dispensing nozzle, is configured to allow the substance to be dispensed through the dispensing nozzle and through the at least one aperture in the body, and wherein the body comprises a piercer that is configured to pierce a seal of the dispensing nozzle when the body second end is removably secured to the dispensing nozzle.

25. A cap configured to be removably secured to a dispensing nozzle of a container, the cap comprising:

a body having a first end and an opposite second end, wherein the first end and the second end are each configured to be removably secured to the dispensing nozzle; and at least one aperture in a sidewall of the body that is in fluid communication with the second end, wherein the first end, when secured to the dispensing nozzle, is configured to prevent a substance in the container from being dispensed through the dispensing nozzle, wherein the second end, when secured to the dispensing nozzle, is configured to allow the substance to be dispensed through the dispensing nozzle and through the at least one aperture in the body, and wherein an exterior surface of the sidewall comprises a plurality of grooves and ridges that are configured to facilitate application of the substance onto a surface when the substance is dispensed through the at least one aperture in the body.

26. A cap configured to be removably secured to a dispensing nozzle of a container, the cap comprising:

a body having a first end and an opposite second end, wherein the first end and the second end are each configured to be removably secured to the dispensing nozzle; and at least one aperture in a sidewall of the body that is in fluid communication with the second end, wherein the first end, when secured to the dispensing nozzle, is configured to prevent a substance in the container from being dispensed through the dispensing nozzle, wherein the second end, when secured to the dispensing nozzle, is configured to allow the substance to be dispensed through the dispensing nozzle and through the at least one aperture in the body, and wherein at least a portion of an exterior surface of the sidewall comprises a plurality of nubs extending outward therefrom that are configured to facilitate application of the substance onto a surface when the substance is dispensed through the at least one aperture in the body.

* * * * *